US011952784B2

(12) United States Patent
Perra

(10) Patent No.: US 11,952,784 B2
(45) Date of Patent: Apr. 9, 2024

(54) PANEL AND COVERING COMPRISING THE SAME

(71) Applicant: I4F Licensing NV, Hamont-Achel (BE)

(72) Inventor: Antonio Giuseppe Perra, Bergen (NL)

(73) Assignee: i4F Licensing NV, Turnhout (BE)

( * ) Notice: Subject to any disclaimer, the term of this patent is extended or adjusted under 35 U.S.C. 154(b) by 9 days.

(21) Appl. No.: 17/427,021

(22) PCT Filed: Jan. 30, 2019

(86) PCT No.: PCT/NL2019/050057

§ 371 (c)(1),
(2) Date: Jul. 29, 2021

(87) PCT Pub. No.: WO2020/159355

PCT Pub. Date: Aug. 6, 2020

(65) Prior Publication Data

US 2022/0136256 A1 May 5, 2022

(51) Int. Cl.

| | |
|---|---|
| ***E04F 15/02*** | (2006.01) |
| ***E04F 13/08*** | (2006.01) |
| ***E04F 13/10*** | (2006.01) |
| ***E04F 15/04*** | (2006.01) |
| ***E04F 15/10*** | (2006.01) |

(52) U.S. Cl.

CPC .... *E04F 15/02038* (2013.01); *E04F 13/0866* (2013.01); *E04F 13/0894* (2013.01); *E04F 13/10* (2013.01); *E04F 15/046* (2013.01); *E04F 15/107* (2013.01); *E04F 2201/01* (2013.01); *E04F 2203/065* (2013.01)

(58) Field of Classification Search

CPC ..... E04F 15/02038; E04F 13/0894; E04F 15/046; E04F 15/107; E04F 2201/01; E04F 2203/065

See application file for complete search history.

(56) References Cited

U.S. PATENT DOCUMENTS

| | | | | |
|---|---|---|---|---|
| 3,694,983 | A | 10/1972 | Couquet | |
| 4,426,820 | A | 1/1984 | Terbrack et al. | |
| 6,216,409 | B1 * | 4/2001 | Roy | E04F 15/04 52/592.4 |
| 6,685,391 | B1 * | 2/2004 | Gideon | E02B 3/14 405/20 |

(Continued)

FOREIGN PATENT DOCUMENTS

| | | | |
|---|---|---|---|
| CN | 102146727 | B | 3/2012 |
| EP | 2440724 | A2 | 4/2012 |

(Continued)

*Primary Examiner* — Gisele D Ford
(74) *Attorney, Agent, or Firm* — The Webb Law Firm

(57) ABSTRACT

The present invention relates to a panel and to a covering including a plurality of such panels. The present invention particularly relates to floor panels, and more in particular to laminated floor panels, hardwood floor panels, solid wood floor panels, or PVC based floor panels. The invention proposes a coupling of the tongues of different adjacent panels that are arranged on the short side of those panels by a tongue of a further panel that is arranged on the long side of that panel. Compared to prior art panels, an improved coupling between the short sides of adjacent panels can be achieved, reducing the likelihood that these panels become detached.

9 Claims, 4 Drawing Sheets

(56) References Cited

U.S. PATENT DOCUMENTS

| | | | | |
|---|---|---|---|---|
| 7,131,242 | B2 * | 11/2006 | Martensson | E04F 15/02 52/592.1 |
| 8,806,832 | B2 * | 8/2014 | Kell | E04F 15/107 52/592.4 |
| 9,217,250 | B2 * | 12/2015 | Perra | E04C 2/38 |
| 9,885,187 | B2 * | 2/2018 | Kell | E04F 15/02033 |
| 10,865,571 | B2 * | 12/2020 | Kell | E04F 13/0889 |
| 11,208,814 | B2 * | 12/2021 | De Rick | E04F 15/107 |
| 11,319,712 | B2 * | 5/2022 | Hannig | E04F 15/105 |
| 2005/0028474 | A1 * | 2/2005 | Kim | E04F 15/04 52/578 |
| 2011/0265409 | A1 | 11/2011 | Pien | |
| 2012/0066996 | A1 | 3/2012 | Konstanczak | |
| 2013/0309441 | A1 * | 11/2013 | Hannig | E04F 15/102 29/428 |
| 2013/0333182 | A1 * | 12/2013 | Pervan | E04F 15/02038 29/426.3 |
| 2014/0083034 | A1 * | 3/2014 | Albert | E04C 2/20 156/308.2 |
| 2014/0215946 | A1 * | 8/2014 | Roy | E04F 15/02 52/309.1 |
| 2015/0240500 | A1 * | 8/2015 | Stevens, Jr. | E04F 15/105 52/588.1 |
| 2017/0241136 | A1 * | 8/2017 | Kell | E04F 15/02038 |
| 2017/0370109 | A1 * | 12/2017 | Devos | E04F 15/02038 |
| 2018/0010342 | A1 * | 1/2018 | Van Hooydonck | E04F 15/105 |
| 2020/0318360 | A1 * | 10/2020 | De Rick | E04F 15/02038 |
| 2021/0002907 | A1 * | 1/2021 | Boucké | E04F 15/02038 |
| 2021/0062517 | A1 * | 3/2021 | Markovski | E04F 15/10 |
| 2021/0381254 | A1 * | 12/2021 | Boucké | E04F 15/105 |
| 2021/0381256 | A1 * | 12/2021 | Ceysson | E04F 15/02038 |
| 2021/0404189 | A1 * | 12/2021 | Boucké | E04F 15/102 |
| 2022/0025658 | A1 * | 1/2022 | Kell | E04F 15/0215 |
| 2022/0034097 | A1 * | 2/2022 | Boucké | B32B 27/08 |
| 2022/0325531 | A1 * | 10/2022 | Perra | E04F 15/102 |

FOREIGN PATENT DOCUMENTS

| | | | |
|---|---|---|---|
| JP | 20024552 | A | 1/2002 |
| JP | 2011140863 | A | 7/2011 |
| JP | 201247036 | A | 3/2012 |
| WO | 2010143962 | A2 | 12/2010 |
| WO | 2016105266 | A1 | 6/2016 |

* cited by examiner

PANEL AND COVERING COMPRISING THE SAME

CROSS-REFERENCE TO RELATED APPLICATION

This application is the United States national phase of International Application No. PCT/NL2019/050057 filed Jan. 30, 2019, the disclosure of which is hereby incorporated by reference in its entirety.

BACKGROUND OF THE INVENTION

Field of the Invention

The present invention relates to a panel and to a covering comprising a plurality of such panels. The present invention particularly relates to floor panels, and more in particular to laminated floor panels, hardwood floor panels, solid wood floor panels, or poly-vinyl-chloride (PVC) based floor panels.

Description of Related Art

A laminated floor panel typically comprises a core having a bottom part and an upper part. The core generally comprises a lower extension region extending from the bottom part of the core at a first and second side of the panel and comprises an upper extension region extending from the upper part of the core at a third and fourth side of the panel, wherein the third and fourth sides are opposite to the first and second sides, respectively.

The core typically comprises a medium-density fiberboard (MDF) or a high-density fiberboard (HDF) layer. An underlayment can be arranged in between the floor panels and the subflooring to act as a sound barrier.

Most panels have a rectangular shape. In such case, the abovementioned first and third sides of the panel may refer to the so-called short sides of the rectangular panel, which extend in a lateral direction. The second and fourth sides of the panel may refer to the so-called long sides of the panel, which extend in a longitudinal direction.

An example of such a panel is known from EP 2440724. In this panel, the lower extension region comprises a first upward tongue that runs at a distance from and parallel to a first inner wall of the core at the first side of the panel, and a second upward tongue that runs at a distance from and parallel to a second inner wall of the core at the second side of the panel. In addition, the upper extension region comprises a third downward tongue that runs at a distance from and parallel to a third inner wall of the core at the third side of the panel, and a fourth downward tongue that runs at a distance from and parallel to a fourth inner wall of the core at the fourth side of the panel.

A clearance between the first upward tongue and the first inner wall of the core defines a first upward groove configured for receiving a third downward tongue of an adjacent panel among the plurality of panels. A clearance between the second upward tongue and the second inner wall of the core defines a second upward groove configured for receiving a fourth downward tongue of an adjacent panel among the plurality of panels. A clearance between the third downward tongue and the third inner wall of the core defines a third downward groove configured for receiving a first upward tongue of an adjacent panel among the plurality of panels. A clearance between the fourth downward tongue and the fourth inner wall of the core defines a fourth downward groove configured for receiving a second upward tongue of an adjacent panel among the plurality of panels.

The first upward tongue and the third downward tongue each comprise a first side wall that extends in parallel to the second inner wall of the core. Furthermore, the first upward tongue and the third downward tongue each comprise a second side wall that extends in parallel to the fourth inner wall of the core.

A well known problem of coverings comprising these floor panels is related to thermal expansion or contraction, particularly when the floor panels are subjected to moisture. As a result of the mechanical stresses associated with contraction or expansion of the floor panels, a gap between adjacent panels may become visible, particularly at the short sides of the panels. In even more extreme cases, the panels may detach from each other. For example, a first upward tongue of a given panel may detach from the third downward groove of an adjacent panel and the third downward tongue of the adjacent panel may detach from the first upward groove of the given panel.

SUMMARY OF THE INVENTION

An object of the present invention is to provide a panel in which these problems do not occur or at least to a lesser extent.

According to the invention, this object is achieved with a panel as described which is characterized in that the first side wall of the first upward tongue and the first side wall of the third downward tongue each comprise a first coupling element, wherein the first coupling elements each extend along the longitudinal direction. Moreover, the fourth downward tongue comprises a second coupling element extending along the longitudinal direction and arranged on an outer side of the fourth downward tongue. According to the invention, when the first upward tongue of the panel is coupled in a third downward groove of a first adjacent panel among the plurality of panels and the third downward tongue of the first adjacent panel is coupled in the first upward groove of the panel, the first coupling elements of the first upward tongue of the panel and the third downward tongue of the first adjacent panel align to form an essentially continuous first coupling element. In addition, when the fourth downward tongue of a second adjacent panel among the plurality of panels is coupled in the second upward groove of the panel and the second upward groove of the first adjacent panel, the second coupling element cooperates with the essentially continuous first coupling element for the purpose of simultaneously locking the first upward tongue of the panel, the third downward tongue of the first adjacent panel, and the fourth downward tongue of the second adjacent panel.

The invention proposes a coupling of the tongues of different adjacent panels that are arranged on the short side of those panels by a tongue of a further panel that is arranged on the long side of that panel. Compared to prior art panels, an improved coupling between the short sides of adjacent panels can be achieved, reducing the likelihood that these panels become detached.

Preferably, the second inner wall of the core also comprises a first coupling element extending along the longitudinal direction such that when the first upward tongue of the panel is coupled in the third downward groove of the first adjacent panel and the third downward tongue of the first adjacent panel is coupled in the first upward groove of the panel, the first coupling elements of the first upward tongue of the panel, the second inner wall of the core of the panel, and third downward tongue of the first adjacent panel align to form said essentially continuous first coupling element.

A cross section of the first coupling element along the longitudinal direction may be substantially constant among the first upward tongue, the third downward tongue, and the second inner wall. In this manner, the positioning of the second adjacent panel relative to the first adjacent panel and the panel is less critical.

Additionally or alternatively, the continuous first coupling element may not only extend over the boundary between the first upward tongue of the panel and the third downward tongue of the first adjacent panel but extend over substantially the full length of both panels.

The first coupling element may comprise one of a recess and a protrusion, and the second coupling element may comprise the other of a recess and protrusion.

In the above, the first coupling element was realized on the second inner wall. However, such coupling element could also be provided on the fourth inner wall. To that effect, the present invention provides, according to a second aspect, a panel as described. In this panel, the third downward tongue and the first upward tongue each comprise a second side wall that extends in parallel to the fourth inner wall of the core. The panel is characterized in that the second side wall of the third downward tongue and the second side wall of the first upward tongue each comprise a third coupling element, wherein the third coupling elements each extend along the longitudinal direction. Moreover, the second upward tongue comprises a fourth coupling element extending along the longitudinal direction and arranged on an outer side of the second upward tongue. According to this second aspect of the invention, when the first upward tongue of the panel is coupled in a third downward groove of a first adjacent panel among the plurality of panels and the third downward tongue of the first adjacent panel is coupled in the first upward groove of the panel, the third coupling elements of the first upward tongue of the panel and the third downward tongue of the first adjacent panel align to form an essentially continuous third coupling element. In addition, when the second upward tongue of a third adjacent panel among the plurality of panels is coupled in the fourth downward groove of the panel and the fourth downward groove of the first adjacent panel, the fourth coupling element cooperates with the essentially continuous third coupling element for the purpose of simultaneously locking the third downward tongue of the first adjacent panel, the first upward tongue of the panel, and the second upward tongue of the third adjacent panel.

Preferably, the fourth inner wall of the core also comprises a third coupling element extending along the longitudinal direction such that when the first upward tongue of the panel is coupled in the third downward groove of the first adjacent panel and the third downward tongue of the first adjacent panel is coupled in the first upward groove of the panel, the third coupling elements of the first upward tongue of the panel, the second inner wall of the core of the panel, and the third downward tongue of the first adjacent panel align to form said essentially continuous third coupling element.

A cross section of the third coupling element along the longitudinal direction may be substantially constant among the first upward tongue, the third downward tongue, and the second inner wall. In this manner, the positioning of the second adjacent panel relative to the first adjacent panel and the panel is less critical.

Additionally or alternatively, the continuous third coupling element may not only extend over the boundary between the first upward tongue of the panel and the third downward tongue of the first adjacent panel but extend over substantially the full length of both panels.

The third coupling element may comprise one of a recess and a protrusion, and the fourth coupling element may comprise the other of a recess and protrusion.

Up to this point, a panel has been described in which a first coupling element is arranged on the second inner wall, and a panel has been described in which a third coupling element is arranged on the fourth inner wall. However, the invention also provides, according to a third aspect, a panel in which these coupling elements are combined. Such a panel is described in claim 11 and the claims dependent thereon.

Panels according to the first, second, or third aspect of the invention, may further comprise a fifth coupling element arranged on at least one of an outer side of the first upward tongue, an inner side of the first upward tongue, and the first inner wall, and a sixth coupling element arranged on at least one of the third inner wall, an inner side of the third downward tongue, and an outer side of the third downward tongue, respectively, wherein the fifth coupling element and the sixth coupling element are complementary to each other. The fifth and sixth coupling elements provide an additional coupling between the short sides of adjacent panels. Also here, the fifth coupling element may be one of a recess and a protrusion, and the sixth coupling element may be the other of the recess and protrusion. Moreover, the fifth and sixth coupling elements may have a constant cross section along the lateral direction.

The core of the panel(s) of the invention is/are made from at least one of medium-density fiberboard (MDF), a high-density fiberboard (HDF), and a poly-vinyl-chloride.

Although the first to sixth coupling elements can be configured as either a recess or protrusion, e.g. a bulge, other coupling elements are not excluded.

With respect to the first and second coupling elements, it may be advantageous if the first coupling element comprises one of a first locking element and a second locking element, the second coupling element comprising the other of a first locking element and a second locking element. A first relevant wall can be identified as being the first side wall of the first upward tongue, the second inner wall of the panel, or the first side wall of the third downward tongue, and a second relevant wall can be identified as being the outer side of the fourth downward tongue.

The first locking element may comprise a recess extending inwardly relative to one of the first or second relevant wall, wherein the recess has a bottom and side walls extending from the bottom to an outside of said one of the first or second relevant wall. The first locking element further comprises a protruding portion extending from the bottom toward the outside of said one of the first or second relevant wall.

The second locking element may comprise a protruding portion comprising side walls that extend outwardly from an outside of the other of the first and second relevant wall, respectively, to a base portion, and a recess extending from the base portion inwardly relative to said other of the first and second relevant wall.

Similarly, with respect to the third and fourth coupling elements, it may be advantageous if the third coupling element comprises one of a first locking element and a second locking element, the fourth coupling element comprising the other of a first locking element and a second locking element. A third relevant wall can be identified as being the second side wall of the first upward tongue, the fourth inner wall of the panel, or the second side wall of the third downward tongue. A fourth relevant wall can be identified as being the outer side of the second upward tongue.

The first locking element may comprise a recess extending inwardly relative to one of the third or fourth relevant wall, wherein the recess has a bottom and side walls extending from the bottom to an outside of said one of the third or fourth relevant wall. The first locking element may further comprise a protruding portion extending from the bottom toward the outside of said one of the third or fourth relevant wall.

The second locking element may comprise a protruding portion comprising side walls that extend outwardly from an outside of the other of the third and fourth relevant wall, respectively, to a base portion, and a recess extending from the base portion inwardly relative to said other of the third and fourth relevant wall.

With respect to the fifth and sixth coupling elements, it may be advantageous if the fifth coupling element comprises one of a first locking element and a second locking element, the sixth coupling element comprising the other of a first locking element and a second locking element. A fifth relevant wall can be identified as being one of an outer side of the first upward tongue, an inner side of the first upward tongue, and the first inner wall. A sixth relevant wall can be identified as being the third inner wall, an inner side of the third downward tongue, and an outer side of the third downward tongue, respectively.

The first locking element may comprise a recess extending inwardly relative to one of the fifth or sixth relevant wall, wherein the recess has a bottom and side walls extending from the bottom to an outside of said one of the fifth or sixth relevant wall. The first locking element may further comprise a protruding portion extending from the bottom toward the outside of said one of the fifth or sixth relevant wall.

The second locking element may comprise a protruding portion comprising side walls that extend outwardly from an outside of the other of the fifth or sixth relevant wall, respectively, to a base portion, and a recess extending from the base portion inwardly relative to said other of the fifth or sixth relevant wall.

For each of the first to sixth coupling elements as described above, the protruding portion of the second locking element can be divided, by the recess of the second locking element, into two oppositely arranged protruding sub-portions. Moreover, the recess of the first locking element can be divided, by the protruding portion of the first locking element, into two oppositely arranged sub-recesses. The protruding portion of the first locking element can be configured to be received in the recess of the second locking element, and each protruding sub-portion of the second locking element can be configured to be received in a respective sub-recess of the first locking element.

The present invention proposes a novel combination of locking elements that are relatively easy to manufacture. In addition, a triple lock function is obtained. More in particular, a first lock comprises the coupling between the protruding portion of the first locking element and the recess of the second locking element. A second lock and a third lock are formed by the respective coupling between the sub-recesses of the first locking element and the protruding sub-portions of the second locking element.

The Applicant has found that by employing the first and second locking element as defined above an appropriate locking between adjacent panels can be achieved while reducing complexity and/or costs of manufacturing the panel.

For each of the first to sixth coupling elements, the protruding portion of the first locking element is preferably fully arranged in the recess of the first locking element and the recess of the second locking element is preferably fully arranged in the protruding portion of the second locking element.

The abovementioned combinations will be described in more detail using the following table will be used:

| Coupling element pair | Relevant wall (1) | Relevant wall (2) |
|---|---|---|
| 1 + 2 | Second inner wall, first side wall first upward tongue, first side wall third downward tongue | Outer edge fourth downward tongue |
| 3 + 4 | Fourth inner wall, second side wall first upward tongue, second side wall third downward tongue | Outer edge second upward tongue |
| 5 + 6 | Outer edge first upward tongue | Third inner wall |
| 5 + 6 | Inner edge first upward tongue | Inner edge third downward tongue |
| 5 + 6 | First inner wall | Outer edge third downward tongue |

In this table, a coupling pair refers to a combination of a) the first and second coupling elements, b) the third and fourth coupling elements, or c) the fifth and sixth coupling elements.

The column indicating relevant wall (1) relates to a particular wall on which one of the first and second locking elements is arranged, whereas the column indicating relevant wall (2) relates to a particular wall on which the other of the first and second locking element is arranged.

For each of the abovementioned pairs of coupling elements, one coupling element may comprise the first locking element, and the other coupling element may comprise the second locking element. For example, coupling element pair 1+2 refers to the combination of the first and second coupling element. The first locking element may then be arranged on the second inner wall, the first side wall of the first upward tongue, and/or on the first side wall of the third downward tongue (relevant wall (1)). Alternatively, the first locking element is arranged on the outer side of the fourth downward tongue (relevant wall (2)). The second locking element is then arranged on the other relevant wall.

The first locking element may comprise a pair of further protrusions arranged on opposite sides of the recess of the first locking element, and the second locking element may comprise a pair of further recesses arranged on opposite sides of the protruding portion of the second locking element, wherein each of the further recesses is configured to receive a respective further protrusion. In this manner additional locking functionality can be achieved.

According to a fourth aspect, the invention provides a covering comprising a plurality of identical panels as defined above, wherein the first upward tongue of a first panel among the plurality of panels is coupled to the third downward groove of a second panel among the plurality of panels, wherein the first upward groove of the first panel is coupled to the third downward tongue of the second panel, wherein the fourth downward tongue of a third panel among the plurality of panels is coupled to the second upward tongue of the first panel and to the second upward tongue of the second panel, wherein the fourth downward groove of the third panel is coupled to the second upward groove of the first panel and to the second upward groove of the second panel, wherein the second upward tongue of a fourth panel among the plurality of panels is coupled to the fourth downward groove of the first panel and to the fourth downward groove of the second panel, and wherein the second upward groove of the fourth panel is coupled to the fourth downward tongue of the first panel and to the fourth downward tongue of the second panel. The covering may be one of a floor covering and a wall covering.

BRIEF DESCRIPTION OF THE DRAWINGS

Next the invention will be described in more detail referring to the appended drawings, wherein.

DESCRIPTION OF THE INVENTION

Figure 1A:
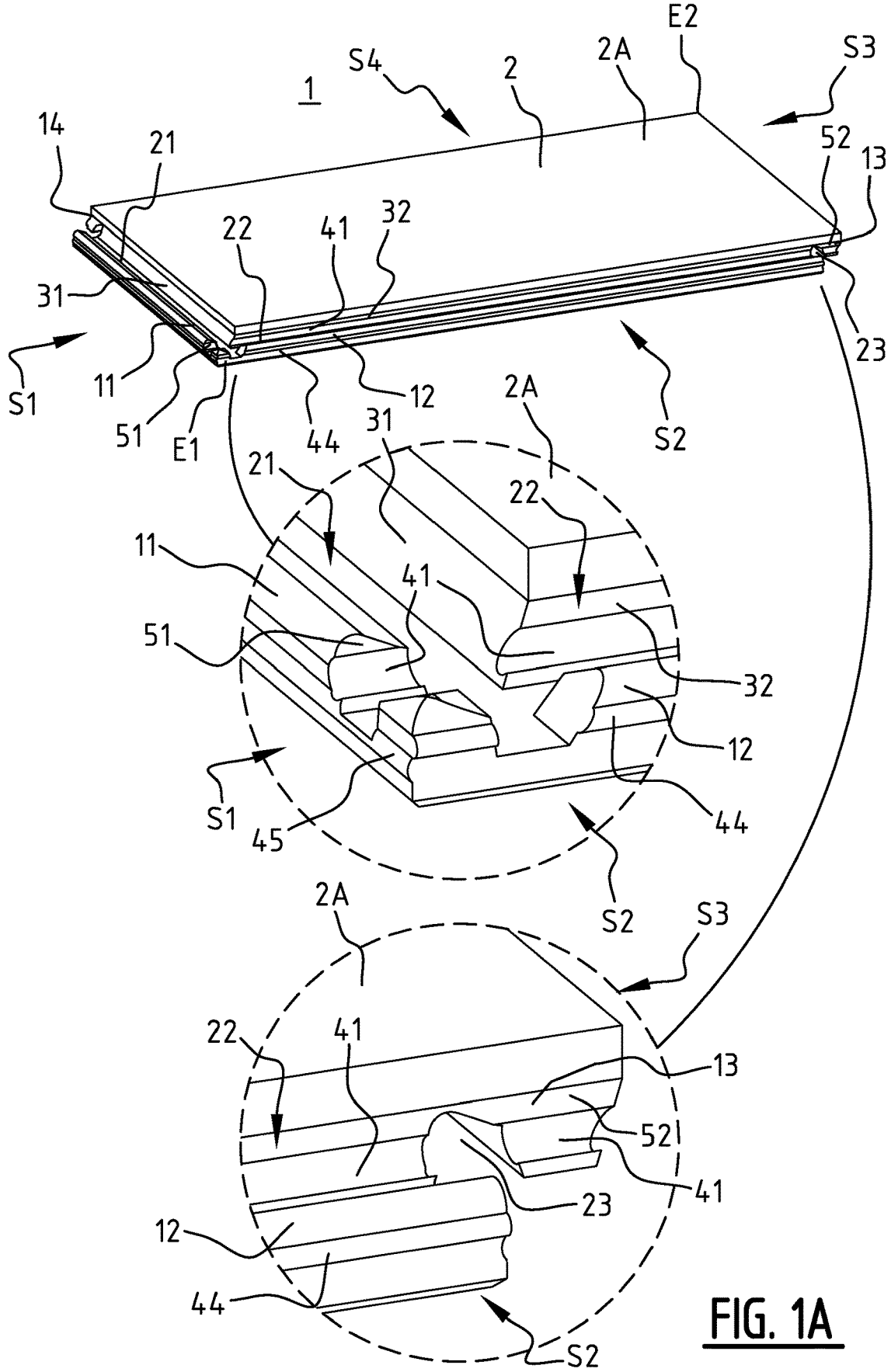
FIGS. 1A and 1B illustrate a top and bottom perspective view, respectively, of a panel in accordance with the invention.
Figure 1B:
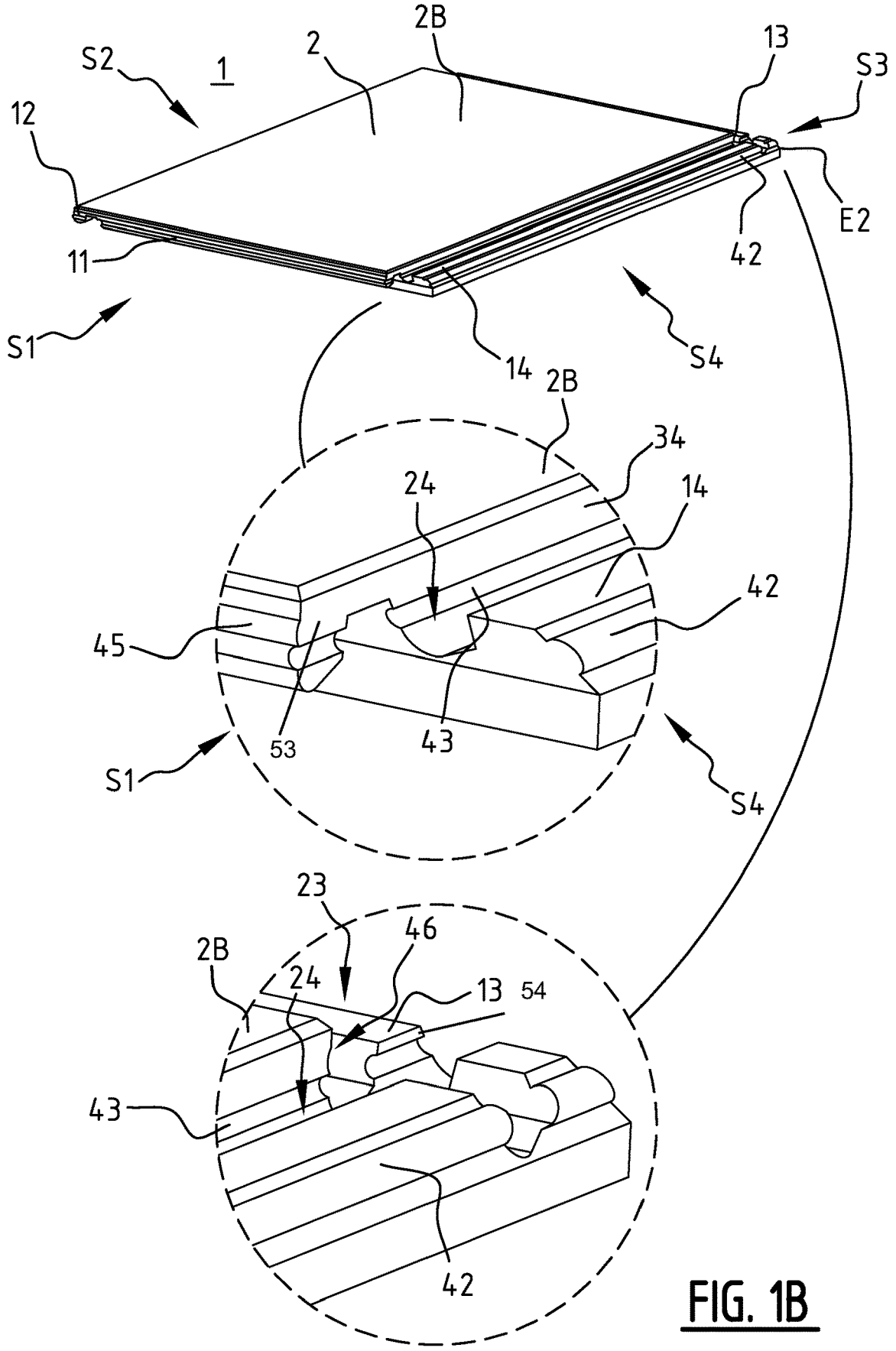
Figure 2A:
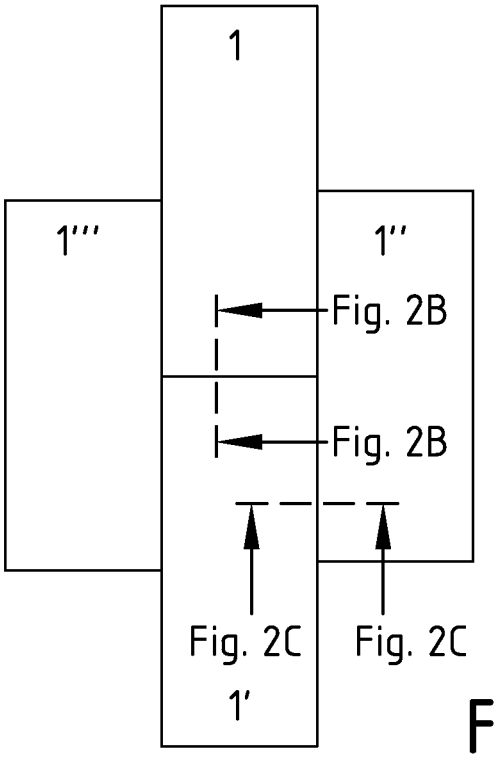
FIG. 2A illustrates an overview of four identical panels as illustrated in FIG. 1 that are coupled together.

FIGS. 1A and 1B illustrate a top and bottom perspective view, respectively, of a panel 1 in accordance with the invention. FIG. 2A illustrates part of a covering using a plurality of the panels as illustrated in FIG. 1A. These panels are referred to as panels 1, 1', 1", 1'". Moreover, this covering could for instance correspond to a floor covering.

Panel 1 comprises a core 2 having a bottom part 2B and an upper part 2A. A lower extension region E1 extends from bottom part 2B of core 2 at a first side S1 and second side S2 of panel 1, see FIG. 1A. An upper extension region E2 extends from upper part 2A of core 2 at a third side S3 and fourth side S4 of panel 1, see FIG. 1B.

Sides S1 and S3 are referred to as the short sides of panel 1, whereas sides S2 and S4 are referred to as the long sides of panel 1.

Lower extension region E1 comprises a first upward tongue 11 that runs at a distance from and parallel to a first inner wall 31 of core 2 at first side S1 of panel 1, and a second upward tongue 12 that runs at a distance from and parallel to a second inner wall 32 of core 2 at second side S2 of panel 1.

As illustrated in FIG. 1B, upper extension region E2 comprises a third downward tongue 13 that runs at a distance from and parallel to a third inner wall 33 of core 2 at third side S3 of panel 1, and a fourth downward tongue 14 that runs at a distance from and parallel to a fourth inner wall 34 of core 2 at fourth side S4 of panel 1.

A clearance between first upward tongue 11 and first inner wall 31 of core 2 defines a first upward groove 21 configured for receiving third downward tongue 13 of an adjacent panel among the plurality of panels.

A clearance between second upward tongue 12 and second inner wall 32 of core 2 defines a second upward groove 22 configured for receiving fourth downward tongue 14 of an adjacent panel among the plurality of panels.

A clearance between third downward tongue 13 and third inner wall 33 of core 2 defines a third downward groove 23 configured for receiving first upward tongue 11 of an adjacent panel among the plurality of panels.

A clearance between fourth downward tongue 14 and fourth inner wall 34 of core 2 defines a fourth downward groove 24 configured for receiving second upward tongue 12 of an adjacent panel among the plurality of panels.

First upward tongue 11 and third downward tongue 13 each comprise a first side wall 51, 52 that extends in parallel to second inner wall 32 of core 2. In addition, first upward tongue 11 and third downward tongue 13 each comprise a second side wall 53, 54 that extends in parallel to fourth inner wall 34 of core 2.

First side wall 51 of first upward tongue 11, first side wall 52 of third downward tongue 13, and second inner wall 32 of core 2 each comprise a first coupling element 41 in the form of a recess. As illustrated in FIG. 1B, fourth downward tongue 14 comprises a second coupling element 42 in the form of a protrusion arranged on an outer side of fourth downward tongue 14.

As shown in FIG. 1B, second side wall 53 of first upward tongue 11, second side wall 54 of third downward tongue 13, and fourth inner wall 34 of core 2 each comprise a third coupling element 43 in the form of a recess. As shown in FIG. 1A, second upward tongue 12 comprises a fourth coupling element 44 in the form of a protrusion arranged on an outer side of second upward tongue 12.

In the coupled state shown in FIG. 2A, first upward tongue 11 of panel 1 is coupled in a third downward groove 13 of a first adjacent panel 1'. Third downward tongue 13 of first adjacent panel 1' is coupled in first upward groove 11 of panel 1.

First coupling elements 41 of first upward tongue 11, third downward tongue 13, and second inner wall 32 of core 2 align to form an essentially continuous first coupling element 41. As shown in FIG. 2C, this continuous first coupling element is engaged by second coupling element 42 arranged on an outer edge of fourth downward tongue 14. As a result, first upward tongue 11 of panel 1, third downward tongue 13 of first adjacent panel 1', and fourth downward tongue 14 of second adjacent panel 1" are mutually locked.

At the same time, third coupling elements 43 of first upward tongue 11, third downward tongue 13, and fourth inner wall 34 of core 2 align to form an essentially continuous third coupling element 43. Similar to the engagement of the continuous first coupling element, the continuous third coupling element is engaged by fourth coupling element 44 arranged on an outer edge of second upward tongue 12 of panel 1'". As a result, first upward tongue 11 of panel 1, third downward tongue 13 of first adjacent panel 1', and second upward tongue 12 of third adjacent panel 1'" are mutually locked. It should be noted that this coupling can also be identified in FIG. 2C because all panels 1-1'" are identical.

Figure 2B:
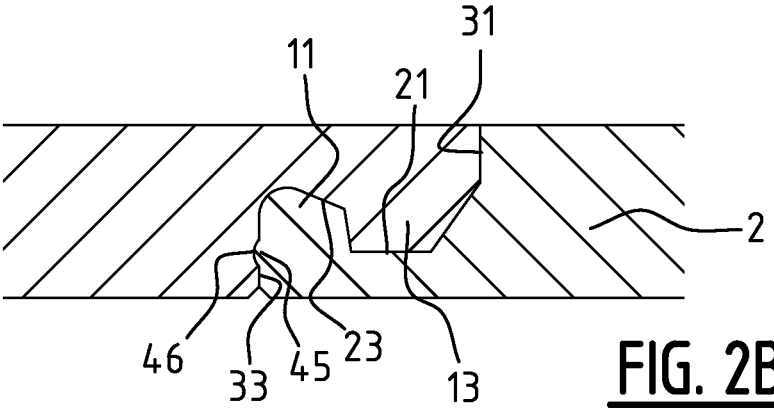
FIGS. 2B-2C two three different cross sections of the panels of FIG. 2A.
Figure 2C:
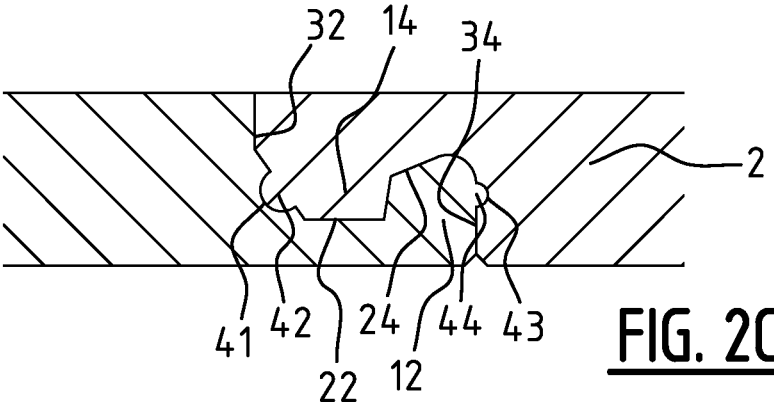

FIG. 2B illustrates an example of a fifth coupling element 45 and a sixth coupling element 46. The present invention equally relates to embodiments where these coupling elements are arranged on different walls of panel 1. For example, different pairs of wall segments can be identified on which the fifth and sixth coupling elements 45, 46 can be arranged. For example, on the pair of wall segments comprising the outer edge of the first upward tongue and the third inner wall, on the pair of wall segments comprising the inner edge of the first upward tongue and the inner edge of the third downward tongue, and on the pair of wall segments comprising the first inner wall and the outer wall of the third downward tongue. The use of the fifth and sixth coupling elements further enhances the coupling between the panels at their short sides.

Figure 3A:
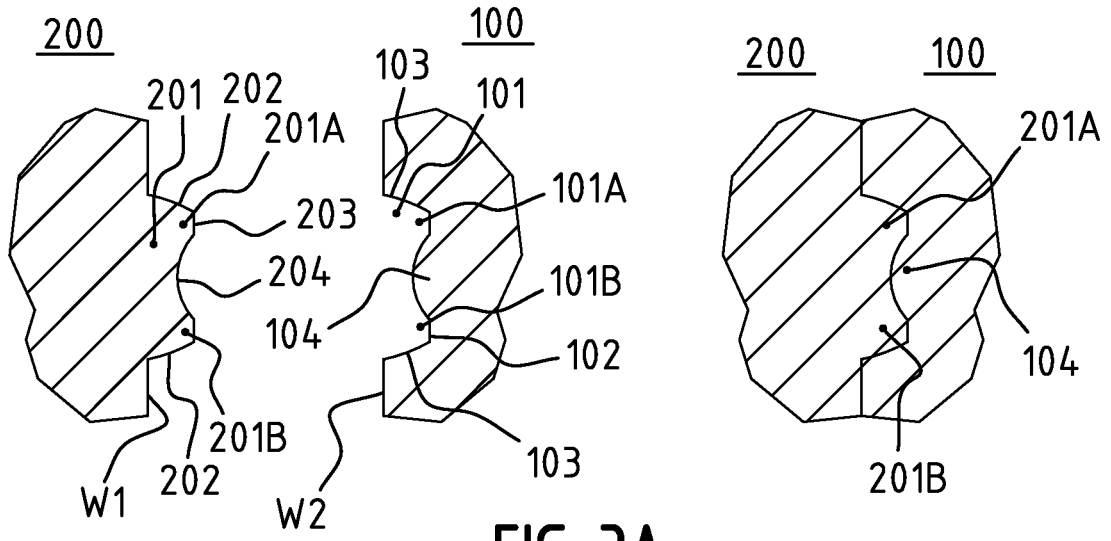
FIGS. 3A-3B illustrate two different embodiments of coupling elements.
Figure 3B:
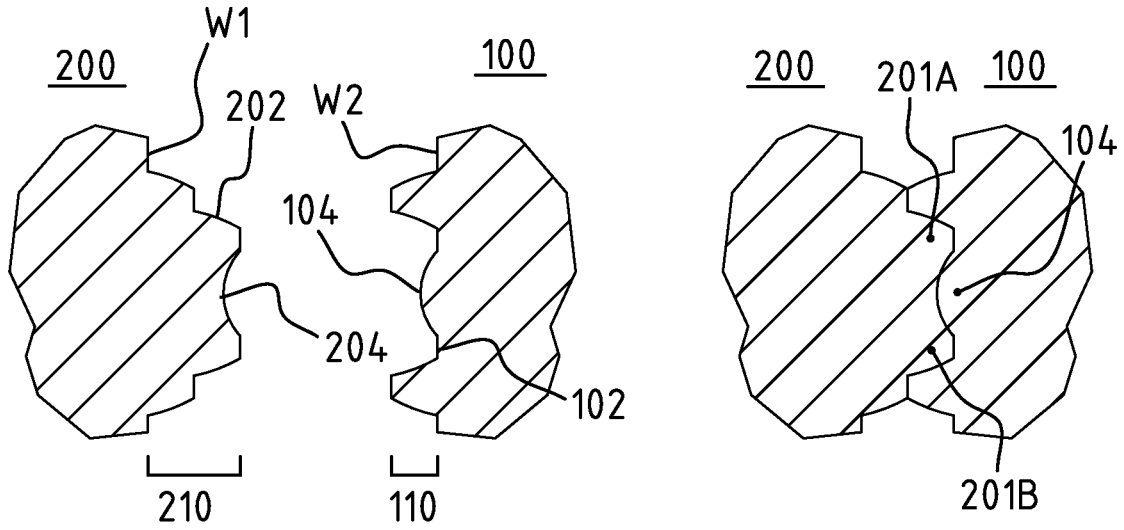

FIGS. 3A and 3B illustrate embodiments of a first locking element 100 and a second locking element 200 in accordance with the present invention. First coupling element 41 may comprise one of the first and second locking element, and second coupling element 42 may comprise the other of the first and second locking element. Additionally or alternatively, third coupling element 43 may comprise one of the first and second locking element, and fourth coupling element 44 may comprise the other of the first and second locking element. Additionally or alternatively, fifth coupling element 45 may comprise one of the first and second locking element, and sixth coupling element 46 may comprise the other of the first and second locking element.

It is noted that FIGS. 3A and 3B illustrate cross sectional views of the locking elements. In actual embodiments, the locking elements are, similar to coupling elements 41-44, elongated structures having a substantially constant cross section along their length. The Applicant has found that these locking elements provide a better locking than the recess and protrusion mentioned in conjunction with FIGS. 1-2.

Each of first locking element 100 and second locking element 200 is arranged on a wall of the panel. Which wall of the panel is used, referred to as the relevant wall, depends on which coupling element comprises the relevant locking element. This is explained in the table below, wherein each possible pair of coupling elements is indicated by two adjacent rows.

| Coupling element comprising the locking element | Relevant wall |
|---|---|
| first coupling element (pair 1) | first side wall first upward tongue, second inner wall, first side wall third downward tongue |
| second coupling element (pair 1) | outer edge fourth downward tongue |
| third coupling element (pair 2) | second side wall first upward tongue, fourth inner wall, second side wall third downward tongue |
| fourth coupling element (pair 2) | outer edge second upward tongue |
| fifth coupling element (pair 3) | outer edge first upward tongue |
| sixth coupling element (pair 3) | third inner wall |
| fifth coupling element (pair 4) | inner edge first upward tongue |
| sixth coupling element (pair 4) | inner edge third downward tongue |
| fifth coupling element (pair 5) | first inner wall |
| sixth coupling element (pair 5) | outer edge third downward tongue |

In FIGS. 3A and 3B, the relevant walls are indicated by W2, which is the relevant wall for first locking element 100, and by W1, which is the relevant wall for second locking element 200. For example, referring to the table above, when first coupling element 41 comprises first locking element 100, relevant wall W2 corresponds to first side wall 51 of first upward tongue 11, second inner wall 32, and/or first side wall 52 of third downward tongue 13. In this case, second coupling element 42 comprises second locking element 200, and relevant wall W1 corresponds to the outer edge of fourth downward tongue 14.

As a further example, when fifth coupling element 45 comprises second locking element 200, relevant wall W1 may correspond to one of the outer edge of first upward tongue 11, the inner edge of first upward tongue 11, and first inner wall 31. In this case, sixth coupling element 46 comprises first locking element 100 and relevant wall W2 may correspond to third inner wall 33, the inner edge of third downward tongue 13, and the outer edge of third downward tongue 13, respectively. However, the locking elements may also be provided on two or three of these walls.

Now returning to FIG. 3A, first locking element 100 is arranged on relevant wall W2 and comprises a recess 101 that extends inwardly relative to relevant wall W2. Recess 101 comprises a bottom 102 and side walls 103 extending from bottom 102 to an outside of relevant wall W2. First locking element 100 further comprises a protruding portion 104 extending from bottom 102 toward the outside of relevant wall W2. As shown, protruding portion 104 is fully arranged in recess 101.

Second locking element 200, assumed to be arranged on relevant wall W1, comprises a protruding portion 201 comprising side walls 202 that extend outwardly from an outside of relevant wall W1 to a base portion 203, and a recess 204 extending from base portion 203 inwardly relative to relevant wall W1. As shown, recess 204 is fully arranged in protruding portion 201.

Protruding portion 201 is divided, by recess 204, into oppositely arranged protruding sub-portions 201A, 201B. In addition, recess 101 is divided, by protruding portion 104, into oppositely arranged sub-recesses 101A, 101B.

As shown in the coupled state in FIG. 3A, right hand side, protruding portion 104 is received in recess 204 and each protruding sub-portion 201A, 201B is received in a respective sub-recess 101A, 101B. In this manner, a triple lock function is obtained by first and second locking elements 100, 200.

FIG. 3B illustrates a modification of first and second locking elements 100, 200 wherein first locking element 100 and second locking element 200 of FIG. 3A are each arranged in or on a respective protruding portion 110, 210 that is arranged on the relevant wall. As shown, bottom 102 of first locking element 100 is substantially in line with the remaining part of relevant wall W2.

In the description above, the present invention has been explained using detailed embodiments thereof. However, the present invention is not limited to these embodiments and various modifications to the embodiments shown can be implemented without departing from the scope of the invention which is defined by the appended claims and their equivalents.

REFERENCE SIGNS

1. Panel

1'. First adjacent panel

1". Second adjacent panel
1'''. Third adjacent panel
2. Core
2A. Upper part core
2B. Bottom part core
11. First upward tongue
12. Second upward tongue
13. Third downward tongue
14. Fourth downward tongue
21. First upward groove
22. Second upward groove
23. Third downward groove
24. Fourth downward groove
31. First inner wall
32. Second inner wall
33. Third inner wall
34. Fourth inner wall
41. First coupling element
42. Second coupling element
43. Third coupling element
44. Fourth coupling element
45. Fifth coupling element
46. Sixth coupling element
51. First side first upward tongue
52. First side third downward tongue
53. Second side first upward tongue
54. Second side third downward tongue
100 First locking element
101 Recess first locking element
101A, 101B Sub-recesses first locking element
102 Bottom first locking element
103 Side walls first locking element
104 Protruding portion first locking element
110 Protruding portion
200 Second locking element
201 Protruding portion second locking element
201A, 201B Protruding sub-portions second locking element
202 Side walls second locking element
203 Base portion second locking element
204 Recess second locking element
210 Protruding portion
E1. Lower extension region
E2. Upper extension region
S1. First side panel
S2. Second side panel
S3. Third side panel
S4. Fourth side panel
W1. Relevant wall second locking element
W2. Relevant wall first locking element

The invention claimed is:

1. A panel configured to be used for constructing a covering that comprises a plurality of said panels, the panel comprising:

a core having a bottom part and an upper part, said core comprising a lower extension region extending from the bottom part of the core at a first and second side of the panel and comprising an upper extension region extending from the upper part of the core at a third and fourth side of the panel, wherein the third and fourth sides are opposite to the first and second sides, respectively;

wherein the panel has a rectangular shape, and wherein the first and third sides of the panel correspond to short sides of the rectangular panel extending in a lateral direction, and wherein the second and fourth sides of the panel correspond to long sides of the panel extending in a longitudinal direction;

wherein the lower extension region comprises a first upward tongue that runs at a distance from and parallel to a first inner wall of the core at the first side of the panel, and a second upward tongue that runs at a distance from and parallel to a second inner wall of the core at the second side of the panel;

wherein the upper extension region comprises a first downward tongue that runs at a distance from and parallel to a third inner wall of the core at the third side of the panel, and a second downward tongue that runs at a distance from and parallel to a fourth inner wall of the core at the fourth side of the panel;

wherein a clearance between the first upward tongue and the first inner wall of the core defines a first upward groove configured for receiving a first downward tongue of an adjacent panel among the plurality of panels;

wherein a clearance between the second upward tongue and the second inner wall of the core defines a second upward groove configured for receiving a second downward tongue of an adjacent panel among the plurality of panels;

wherein a clearance between the first downward tongue and the third inner wall of the core defines a third downward groove configured for receiving a first upward tongue of an adjacent panel among the plurality of panels;

wherein a clearance between the second downward tongue and the fourth inner wall of the core defines a fourth downward groove configured for receiving a second upward tongue of an adjacent panel among the plurality of panels;

wherein the first upward tongue and the first downward tongue each comprise a first side wall that extends in parallel to the second inner wall of the core;

wherein the first side wall of the first upward tongue and the first side wall of the first downward tongue each comprise a first coupling element, wherein the first coupling elements each extend along the longitudinal direction;

wherein the second downward tongue comprises a second coupling element extending along the longitudinal direction and arranged on an outer side of the second downward tongue;

wherein, when the first upward tongue of the panel is coupled in a third downward groove of a first adjacent panel among the plurality of panels and the first downward tongue of the first adjacent panel is coupled in the first upward groove of the panel, the first coupling elements of the first upward tongue of the panel and the first downward tongue of the first adjacent panel align to form an essentially continuous first coupling element;

wherein, when the second downward tongue of a second adjacent panel among the plurality of panels is coupled in the second upward groove of the panel and the second upward groove of the first adjacent panel, the second coupling element cooperates with the essentially continuous first coupling element for the purpose of simultaneously locking the first upward tongue of the panel, the first downward tongue of the first adjacent panel, and the second downward tongue of the second adjacent panel, wherein the first coupling element comprises one of a first locking element and a second locking element, the second coupling element comprises one of the first locking element and the second locking, element, a first respective wall being the first side wall of the first upward tongue, the second inner wall of the panel, or the first side wall of the first downward tongue, and a second respective wall being the outer side of the second downward tongue;

wherein the first locking element comprises a recess extending inwardly relative to one of the first or second respective walls, said recess having a bottom and side walls extending from the bottom to an outside of said one of the first or second respective walls, the first locking element further comprising a protruding portion extending from the bottom toward the outside of said one of the first or second respective walls;

wherein the second locking element comprises a protruding portion comprising side walls that extend outwardly from an outside of one of the first and second respective walls, respectively, to a base portion, and a recess extending from the base portion inwardly relative to said one of the first and second respective walls;

wherein the protruding portion of the second locking element is divided, by the recess of the second locking element, into two oppositely arranged protruding sub-portions;

wherein the recess of the first locking element is divided, by the protruding portion of the first locking element, into two oppositely arranged sub-recesses;

wherein the protruding portion of the first locking element is configured to be received in the recess of the second locking element;

wherein each protruding sub-portion of the second locking element is configured to be received in a respective sub-recess of the first locking element.

2. The panel according to claim 1, wherein the second inner wall of the core also comprises a first coupling element extending along the longitudinal direction such that when the first upward tongue of the panel is coupled in the third downward groove of the first adjacent panel and the first downward tongue of the first adjacent panel is coupled in the first upward groove of the panel, the first coupling elements of the first upward tongue of the panel, the second inner wall of the core of the panel, and the first downward tongue of the first adjacent panel form said essentially continuous first coupling element.

3. The panel according to claim 2, wherein a cross section of each first coupling element along the longitudinal direction is substantially constant among the first upward tongue, the first downward tongue, and the second inner wall.

4. The panel according to claim 2, wherein, when the panel and the adjacent panel are coupled, the first coupling elements of each of the panel and the adjacent panel align to substantially extend over a full length of the panel and the adjacent panel.

5. The panel according to claim 1, wherein each first coupling element comprises one of a recess and a protrusion, and wherein the second coupling element comprises one of a recess and a protrusion.

6. A panel configured to be used for constructing a covering that comprises a plurality of said panels, the panel comprising:

a core having a bottom part and an upper part, said core comprising a lower extension region extending from the bottom part of the core at a first, and second side of the panel and comprising an upper extension region extending from the upper part of the core at a third and fourth side of the panel, wherein the third and fourth sides are opposite to the first and second sides, respectively;

wherein the panel has a rectangular shape and wherein the first and third sides of the panel correspond to short sides of the rectangular panel extending in a lateral direction, and wherein the second and fourth sides of the panel correspond to long sides of the panel extending in a longitudinal direction;

wherein the lower extension region comprises a first upward tongue that runs at a distance from and parallel to a first inner wall of the core at the first side of the panel, and a second upward tongue that runs at a distance from and parallel to a second inner wall of the core at the second side of the panel;

wherein the upper extension region comprises a first downward tongue that runs at a distance from and parallel to a third inner wall of the core at the third side of the panel, and a second downward tongue that runs at a distance from and parallel to a fourth inner wall of the core at the fourth side of the panel;

wherein a clearance between the first upward tongue and the first inner all of the core defines a first upward groove configured for receiving a first downward tongue of all adjacent panel among the plurality of panels;

wherein a clearance between the second upward tongue and the second inner wall of the core defines a second upward groove configured for receiving a second downward tongue of an adjacent panel among the plurality of panels;

wherein a clearance between the first downward tongue and the third inner wall of the core defines a third downward groove configured for receiving a first upward tongue of an adjacent panel among the plurality of panels;

wherein a clearance between the second downward tongue and the fourth inner wall of the core defines a fourth downward groove configured for receiving a second upward tongue of an adjacent panel among the plurality of panels;

wherein the first upward tongue and the first downward tongue each comprise a first side wall that extends in parallel to the second inner wall of the core;

wherein the first side wall of the first upward tongue and the first side wall of the first downward tongue each comprise a first coupling element, wherein the first coupling elements each extend along the longitudinal direction;

wherein e second downward tongue comprises a second coupling element extending along the longitudinal direction and arranged on an outer side of the second downward tongue;

wherein, when the first upward tongue of the panel is coupled in a third downward groove of a first adjacent panel among the plurality of panels and the first downward tongue of the first adjacent panel is coupled in the first upward groove of the panel, the first coupling elements of the first upward tongue of the panel and the first downward tongue of the first adjacent panel align to form an essentially continuous first coupling element;

wherein, when the second downward tongue of a second adjacent panel among the plurality of panels is coupled in the second upward groove of the panel and the second upward groove of the first adjacent panel, the second coupling Clement cooperates with the essentially continuous first coupling element for the purpose of simultaneously locking the first upward tongue of the panel, the first downward tongue of the first adjacent panel, and the second downward tongue of the second adjacent panel, wherein each of the first coupling elements comprises one of a first locking element and a second locking element, and each of the second coupling elements comprises one of the first locking element and the second locking element, a third respective wall being the second side wall of the first upward tongue, the fourth inner wall of the panel, or the second side wall of the first downward tongue, and a fourth respective wall being the outer side of the second upward tongue;

wherein the first locking element comprises a recess extending inwardly relative to one of the third or fourth respective walls, said recess having a bottom and side walls extending from the bottom to an outside of said one of the third or fourth respective walls, the first locking element further comprising a protruding portion extending from the bottom toward the outside of said one of the third or fourth respective walls;

wherein the second locking element comprises a protruding portion comprising side walls that extend outwardly from an outside of one of the third and fourth respective walls, respectively, to a base portion, and a recess extending from the base portion inwardly relative to said one of the third and fourth respective walls;

wherein the protruding portion of the second locking element is divided, by the recess of the second locking element, into two oppositely arranged protruding sub-portions;

wherein the recess of the first locking element is divided, by the protruding portion of the first locking element, into two oppositely arranged sub-recesses;

wherein the protruding portion of the first locking element is configured to be received in the recess of the second locking element;

wherein each protruding sub-portion of the second locking element is configured to be received in a respective sub-recess of the first locking element.

7. A panel configured to be used for constructing a covering that comprises a plurality of said panels, the panel comprising:

a core having a bottom part and an upper part, said core comprising a lower extension region extending from the bottom part of the core at a first and second side of the panel and comprising an upper extension region extending from the upper part of the core at a third and fourth side of the panel, wherein the third and fourth sides are opposite to the first and second sides, respectively;

wherein the panel has a rectangular shape, and wherein the first and third sides of the panel correspond to short sides of the rectangular panel extending in a lateral direction, and wherein the second and fourth sides of the panel correspond to long sides of the panel extending in a longitudinal direction;

wherein the lower extension region comprises a first upward tongue that runs at a distance from and parallel to a first inner wall of the core at the first side of the panel, and a second upward tongue that runs at a distance from and parallel to a second inner wall of the core at the second side of the panel;

wherein the upper extension region comprises a first downward tongue that runs at a distance from and parallel to a third inner wall the core at the third side the panel, and a second downward tongue that runs at a distance from and parallel to a fourth inner wall of the core at the fourth side of the panel;

wherein a clearance between the first upward tongue and the first inner wall of the core defines a first upward groove configured for receiving a first downward tongue of an adjacent panel among the plurality of panels;

wherein a clearance between the second upward tongue and the second inner wall of the core defines a second ti ward groove configured for receiving a second downward tongue of an adjacent panel among the plurality of panels;

wherein a clearance between the first downward tongue and the third inner wall of the core defines a third downward groove configured for receiving a first upward tongue of an adjacent panel among the plurality of panels;

wherein a clearance between the second downward tongue and the fourth inner wall of the core defines a fourth downward groove configured for receiving a second upward tongue of an adjacent panel among the plurality of panels;

wherein the first upward tongue and the first downward tongue each comprise a first side wall that extends in parallel to the second inner wall of the core;

wherein the first side wall of the first upward tongue and the first side wall of the first downward tongue each comprise a first coupling element, wherein the first coupling elements each extend along the longitudinal direction;

wherein the second downward tongue comprises a second coupling element extending along the longitudinal direction and arranged on an outer side of the second downward tongue;

wherein, when the first upward tongue of the panel is coupled in a third downward groove of a first adjacent panel among the plurality of panels and the first downward tongue of the first adjacent panel is coupled in the first upward groove of the panel, the first coupling elements of the first upward tongue of the panel and the first downward tongue of the first adjacent panel align to form an essentially continuous first coupling element;

wherein, when the second downward tongue of a second adjacent panel among the plurality of panels is coupled in the second upward groove of the panel and the second upward groove of the first adjacent panel, the second coupling element cooperates with the essentially continuous first coupling element for the purpose of simultaneously locking the first upward tongue of the panel, the first downward tongue of the first adjacent panel, and the second downward tongue of the second adjacent panel, wherein a first coupling element comprises one of a first locking element and a second locking element, and the second coupling element comprises one of the first locking element and the second locking element, a fifth respective wall being one of an outer side of the first upward tongue, an inner side of the first upward tongue, and the first inner wall, a sixth respective wall being the third inner wall, an inner side of the first downward tongue, and an outer side of the first downward tongue, respectively;

wherein the first locking element comprises a recess extending inwardly relative to one of the fifth or sixth respective walls, said recess having a bottom and side walls extending from the bottom to an outside of said one of the fifth or sixth respective walls, the first locking element further comprising a protruding portion extending from the bottom toward the outside of said one of the fifth or sixth respective walls;

wherein the second locking element comprises a protruding portion comprising side walls that extend outwardly from an outside of one of the fifth or sixth respective walls, respectively, to a base portion, and a recess extending from the base portion inwardly relative to said one of the fifth or sixth respective walls;

wherein the protruding portion of the second locking element is divided, by the recess of the second locking element, into two oppositely arranged protruding sub-portions;

wherein the recess of the first locking element is divided, by the protruding portion of the first locking element, into two oppositely arranged sub-recesses;

wherein the protruding portion of the first locking element is configured to be received in the recess of the second locking element;

wherein each protruding sub-portion of the second locking element is configured to be received in a respective sub-recess of the first locking element.

8. A covering comprising a plurality of identical panels as defined in claim 1, wherein:

the first upward tongue of a first panel among the plurality of panels is coupled to the third downward groove of a second panel among the plurality of panels;

the first upward groove of the first panel is coupled to the first downward tongue of the second panel;

the second downward tongue of a third panel among the plurality of panels is coupled to the second upward tongue of the first panel and to the second upward tongue of the second panel;

the fourth downward groove of the third panel is coupled to the second upward groove of the first panel and to the second upward groove of the second panel;

the second upward tongue of a fourth panel among the plurality of panels is coupled to the fourth downward groove of the first panel and to the fourth downward groove of the second panel; and the second upward groove of the fourth panel is coupled to the second downward tongue of the first panel and to the second downward tongue of the second panel.

9. The covering according to claim 8, wherein the covering is one of a floor covering and a wall covering.

* * * * *